US005643156A

United States Patent [19]

Lochbaum

[11] Patent Number: 5,643,156

[45] Date of Patent: Jul. 1, 1997

[54] FLOAT RESISTANCE MEMBER METHOD AND APPARATUS FOR AQUATIC EXCERISE

[76] Inventor: Kenneth Lochbaum, 3002 E. 38th St., Erie, Pa. 16510

[21] Appl. No.: 570,504

[22] Filed: Dec. 11, 1995

[51] Int. Cl.[6] ..... A63B 21/008

[52] U.S. Cl. ..... 482/111; 482/148

[58] Field of Search ..... 482/111, 148, 482/133, 134, 135, 98, 99, 100

[56] References Cited

U.S. PATENT DOCUMENTS

| | | | |
|---|---|---|---|
| 4,600,189 | 7/1986 | Olschasky et al. | 482/100 |
| 4,632,390 | 12/1986 | Richey | 482/133 |
| 5,236,406 | 8/1993 | Webber | 482/100 |
| 5,242,352 | 9/1993 | Elliot | 482/111 |
| 5,304,107 | 4/1994 | Jones | 482/100 |

*Primary Examiner*—Lynne A. Reichard
*Attorney, Agent, or Firm*—Lovercheck and Lovercheck

[57] ABSTRACT

An exercise device comprising an enclosure containing water having a top surface and a bottom. A base member supported on the bottom. A seat for an exercising person is supported on the base. A float is supported in the water and adapted to be pulled through the water by a force on a cord attached to the float. The float may be air filled or filled with a lighter than water material. The float has an indicia on it to indicate the force from 1–400 pounds that the float is exerting and thereby, the force exerted on the cord by the person. A lever is attached to the handle and to the cord. The person can engage the handle attached to the cord with his hands, feet, chest or back, thereby exercising his body. The float is guided up and down by posts attached to the bottom. Multiple floats may be attached together to adjust the resistance force of the exercise device.

21 Claims, 5 Drawing Sheets

FLOAT RESISTANCE MEMBER METHOD AND APPARATUS FOR AQUATIC EXCERISE

BACKGROUND OF THE INVENTION

This invention relates to aquatic exercise devices and more particularly to aquatic exercise equipment wherein the exercise is carried out in water and the person exercising is substantially or entirely submerged. For example, the water may be up to the neck of the exercising person, or the water may entirely submerge the exercising person. The water may be in a pool or other enclosure of water having a bottom. The aquatic exercise equipment may be attached to the bottom or a base supported on the bottom.

SUMMARY OF THE INVENTION

The aquatic exercise devices each have a float resistance member. The float resistance member comprises a float member, a guide member attached to a side of the float member, a cord attached to the float member, and a post that slidably engages the guide member. The float member may have a belt fastened thereto which secures the cord to the float member. The float member is provided lighter than water so that it will provide a buoyant force when submerged. This buoyant force will provide resistance to the physical activity of the exercising person using the exercise device. The float member may be hollow and water tight providing an air filled pocket. The float member may also be filled with a suitable material such as a closed cell polymeric foam. Such a float member will still be much lighter than water, and if the shell is not water tight, the interior space will not fill with water.

Each float has a guide member attached to at least one side. In a preferred embodiment a guide member is attached to two opposite sides of the float. Each guide member engages a post so that it is guided therealong as the float is pulled down into the water and rises as it is released during exercise. The guide member may be a hollow and fit over the post to be guided therealong as the float is raised and lowered during exercise. A belt around the float and fastened thereto has at a lower portion a ring that has a cord attached thereto. The cord extends through pulley means and is attached at its distal end to a lever. The lever is attached to the bottom or to a base at its lower end, and has a handle at its upper end. An exercising person can engage the handle with hands or feet, and can be disposed in a standing, sitting or reclining position. Appropriate sitting and reclining structure is provided for the exercising person. If the exercise involves fully submerging the exercising person, appropriate equipment is provided for underwater breathing by the person.

In an alternative embodiment, the hollow air filled float member may be provided with a valve in its top surface and a valve near or on its bottom surface whereby water may be admitted to the interior of the float member to adjust the buoyancy force of the float member to provide a desired amount of resistance force for true functional simulation of a particular physical activity. The valves are hand operable. The float member may be entirely or partially formed of a translucent material so that the interior water level can be easily determined. Indicia may be provided to indicate the magnitude of buoyant force that will be provided at a given water level. Such indicia may be a scale running vertically along a side of the float indicating buoyant force for various water levels in the float member.

In an alternative embodiment the hollow air filled float member may be provided with a valve in its top surface, and an open or partially open bottom surface. Water can be added to the float member by opening the valve. Air can be added by air hose under pressure or by lifting the float member out of the water.

In another embodiment, multiple float members are provided. For each exercise the necessary number of float members are stacked to provide the desired amount of resistance force for true functional simulation of the particular physical activity. Each float member has a guide member attached to a side thereof. Each float member will stack on the float member below it so that any number of floats can be stacked. A belt may extend around and be fastened to all of the float members and each of the floats may have fasteners to attach the belt to the float member. The cord is attached to a ring that is secured to the belt. The cord extends from the belt to the lever of the exercise device to impart the resistance force to the exercising person as they grip the handle and move the lever to perform the exercise.

A hole in the top of the float is closed by a valve. The valve can be opened by the operator to allow air to escape so that the water can enter through the bottom opening and the float.

The float is made of transparent material with indicia on the outside surface so that the water inside the float as well as the position of the surface of the water inside the float can be determined. The calibrations can be in pounds so that the float force necessary to be exerted on the cord in order to completely submerge the float can be determined.

It is an object of the present invention to provide an improved aquatic exercise device.

It is another object of the present invention to provide an improved aquatic exercise device with adequate resistance to provide for true functional simulation of specific resistance of particular physical activity.

Another object of the present invention is to provide an aquatic exercise apparatus that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
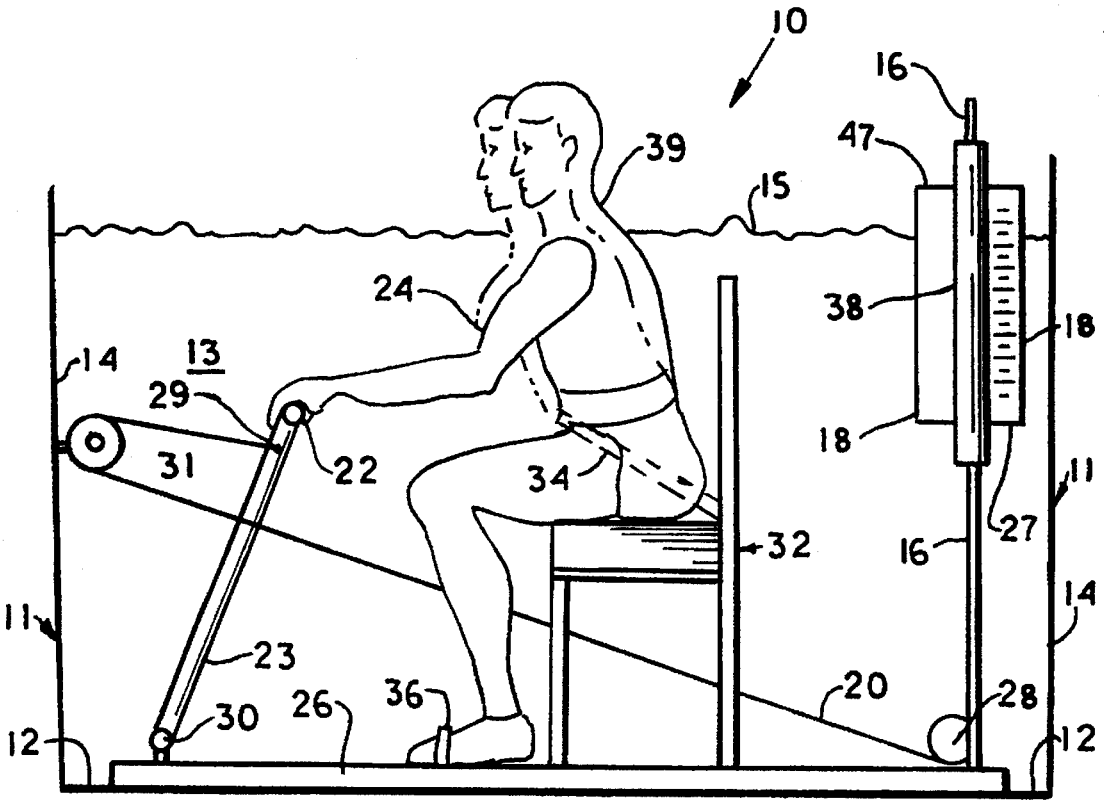
FIG. 1 is a side view of an enclosure of water with one of the sides removed showing an exercising person and the exercising device in the water.
Figure 2:
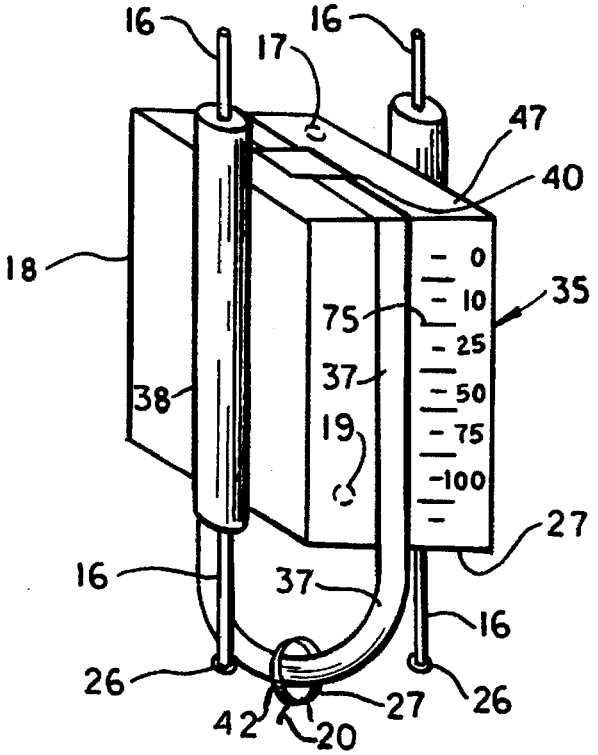
FIG. 2 is an enlarged view of the float, guide members and posts shown in FIG. 1.

Now with more particular reference to the drawings, aquatic exercising device 10 is disclosed. Exercising device 10 is suited for use in a body of water such as that shown as enclosure 11 of water 13. Water 13 has top surface 15. Water 13 in enclosure 11 may be shoulder depth on person 24 using exercising device 10. Water 13 could be deeper or shallower than shown as desired for a given exercise. Enclosure 11 has bottom 12 and side walls 14. Base 26 is supported on bottom 12. Base 26 supports chair 32, first pulley 28, foot stabilizers 36, and posts 16.

Lever 23 is swingably attached to base 26 by pivot 30. End 29 of cord 20 is fixed to lever 23 adjacent handle 22 and cord 20 is attached to ring 27, belt 37 surrounds float 18 and is held by fastener 40. Cord 20 passes around first pulley 28 so that when person 24 pulls handle 22 toward himself, float 18 is pulled down deeper into water 13. When the force on handle 22 is released, float 18 is buoyed up to the surface of water 13.

Float 18 has first valve 17 extending through top 47 and second valve 19 extending through bottom 12. Valves 17,19 can be a poppet valve or any other suitable shut-off valve to selectively retain or release air from float 18.

Float 18 has tubular guide members 38 fixed to its sides. Tubular guide members 38 are attached to each side of float 18 and slidably receive posts 16. Thus, float 18 is guided upward and downward by tubes 38 attached to float 18 which receives posts 16. Person 24 is stabilized in chair 32 by seat belt 34. The water level may be as shown with top surface 15 at the neck of person 24.

Float 18 may be made of transparent material such as LEXAN, with calibration marks 35. Calibration marks 35 can be made to indicate the float force on cord 20 which is a function of the level of the water inside float 18. Calibration marks 35 indicates the force on cord 20 required to submerge float 18. The force may range from 1 to 400 pounds depending on the size of the float. The force generated is about 8 pounds per gallon of enclosed space in the float.

When person 24 exercises with device 10, he sits in chair 32 stabilized by belt 34 and foot stabilizer 36.

Person 24 can pull handle 22 and lever 23 toward himself thereby exerting a downward force transmitted through cord 20 to float 18 through belt 37. The force required for person 24 to pull float 18 below the surface of the water will be indicated by the water level in float 18 and calibration marks 35 thereon.

Figure 3:
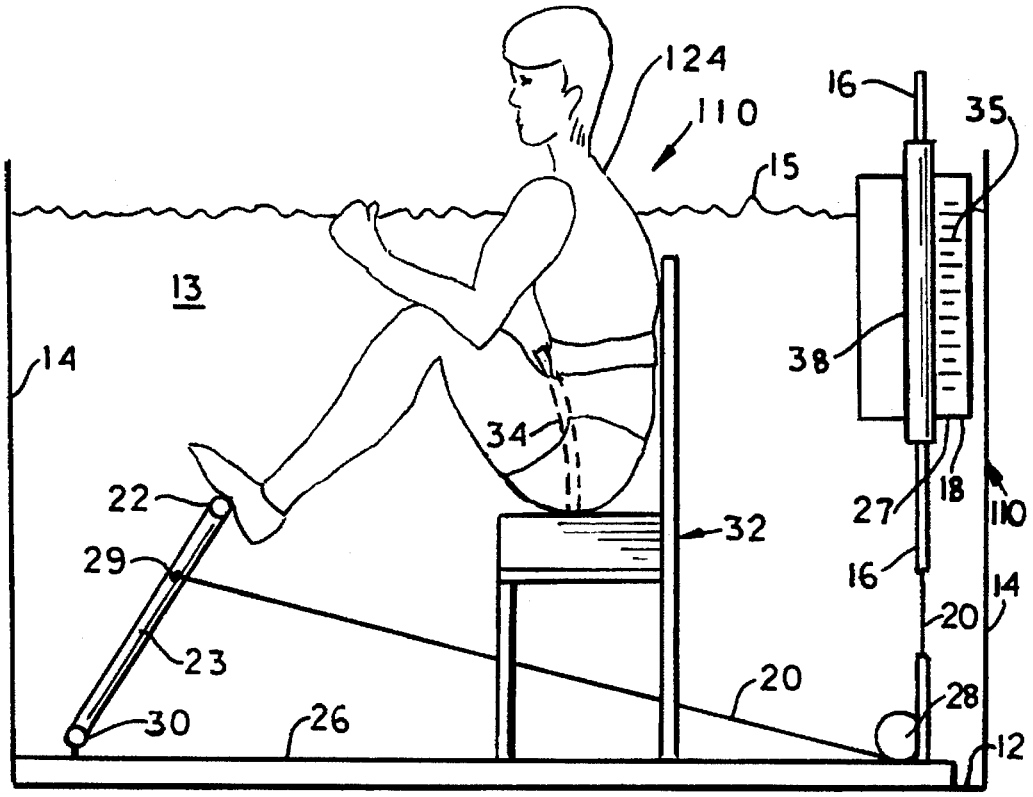
FIG. 3 is a view of the device shown in FIG. 1 for use as a leg exercise device showing a seated exercising person.

FIG. 3 shows exercise device 10 similar to the device described for FIG. 1 to lever 13 to be used as a leg exercise device. Cord 20 is connected directly from first pulley 28 to point 29 on lever 23. The force of the legs of person 124 on handle 22 to swing lever 23 on pivot 30 in a direction away from chair 32. Cord 20 exerts a downward force on float 18. The force required will be indicated on calibrations 35. Person 124 can repeatedly press handle 22 and release handle 22. Thus, pulling float 18 down and releasing float 18 to move to the top of water 13. Thus, person 124 can exercise their legs. If a lesser force is required, air can be released by poppet valve 17 from float 18. Thus, allowing water 13 to enter float 18 and thereby reducing the floatation force. To increase the floatation force of float 18, air can be added to float 18 by means of a suitable pump.

Figure 4:
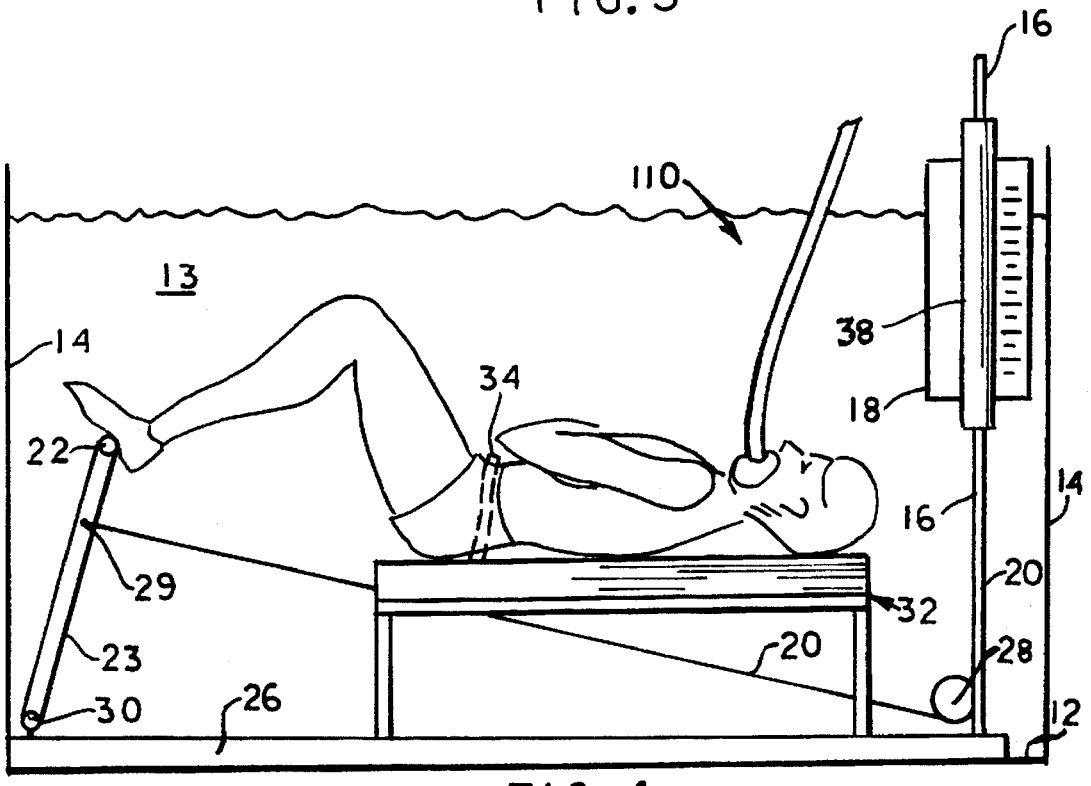
FIG. 4 is a view of the device shown in FIG. 3 showing a reclined exercising person fully submerged and using the device for leg exercise.

FIG. 4 shows exercise device 110 used by a reclining exerciser reclining on support 32'. Exercising device 110 having lever 23. The force of the legs of person 124 on handle 22 to swing lever 23 in a direction away from bench 32'. Cord 20 exerts a downward force on float 18. The force required will be indicated by calibrations 35 on float 18. Breathing equipment 33 enables the person to recline and exercise with his head completely submerged.

Figure 5:
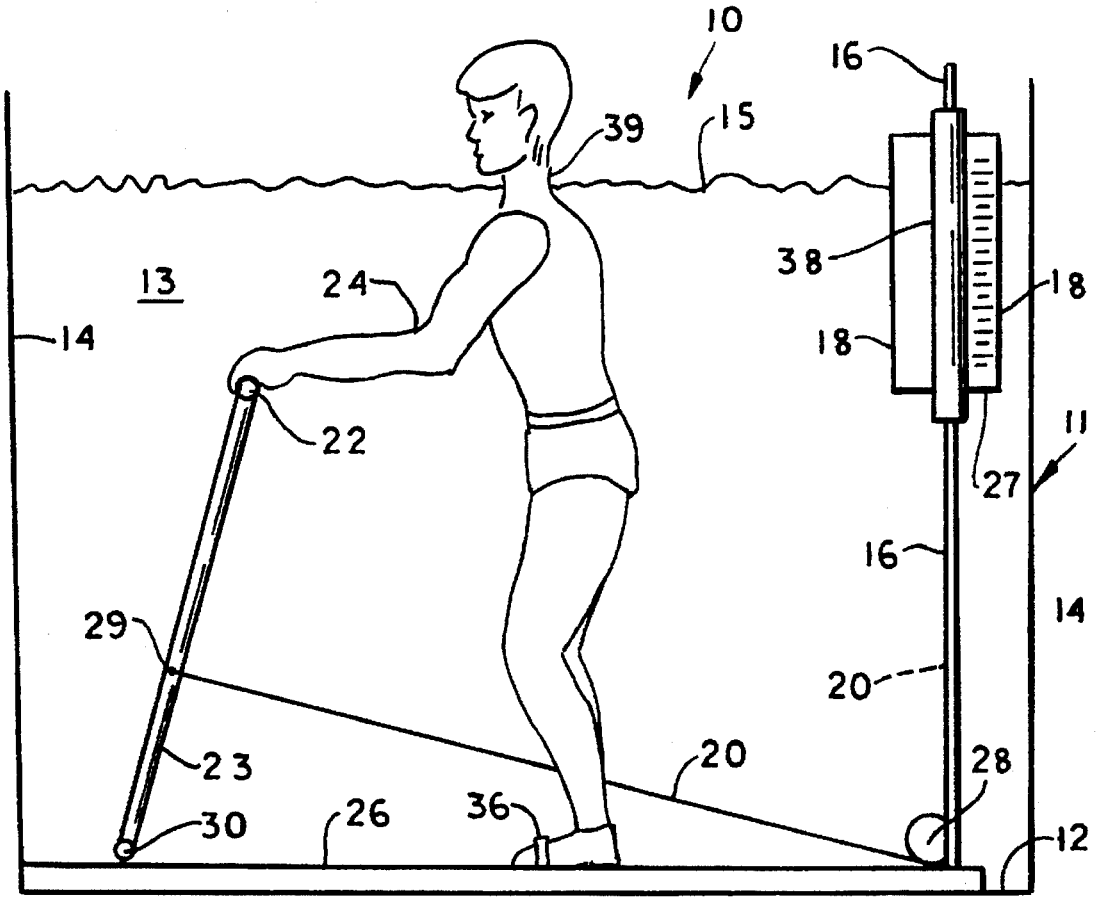
FIG. 5 is a view of the device showing a standing exercising person using the device for arm exercises.

FIG. 5 shows exercise device 10 used by a standing exerciser standing on base 26 and secured in an exercise position by stabilizer 36. The exerciser grips handle 22 and moves lever 23. The force of the arms of the exerciser pulls on cord 20 which exerts a downward force on float 18.

Figure 6:
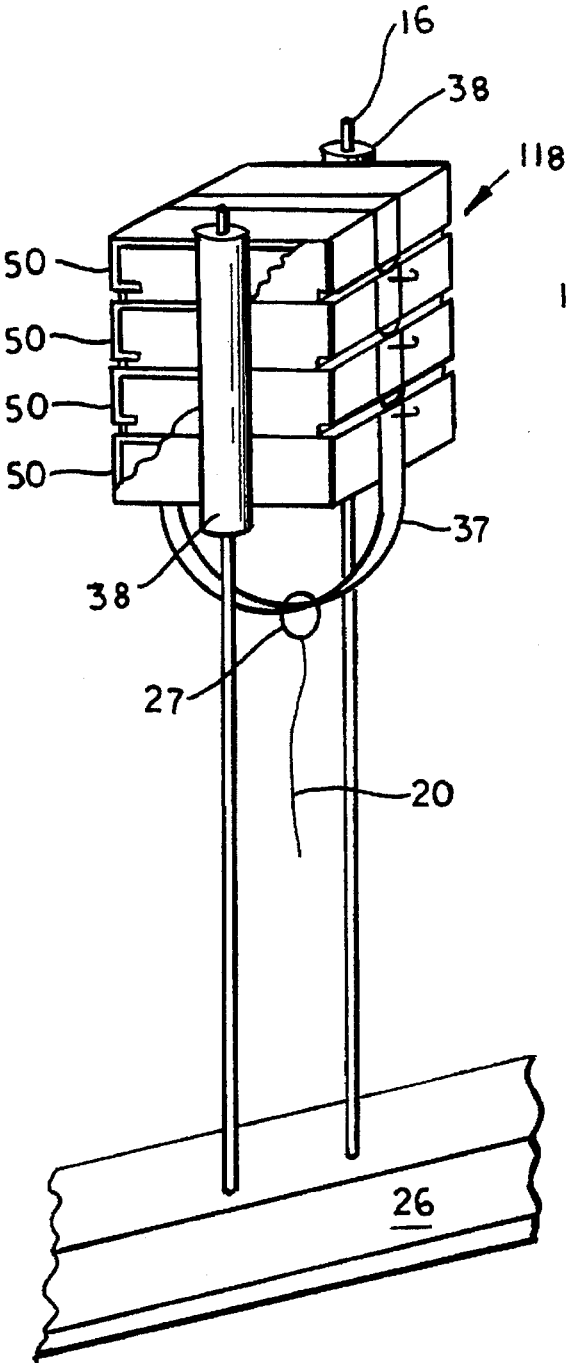
FIG. 6 is a view of another embodiment showing the float in attachable sections to adjust the amount of resistance force provided to the exercise device.

FIG. 6 discloses float 118 made up of hollow attachable float sections 50. Belt 37 surrounds all of float sections 50 which are also attached to tubular guide members 38 which attaches to each side of each float section 50 and slidably receives posts 16. Thus, float 18 is guided upwardly and downwardly by tubes 38. Ring 27 is attached to belt 37 and to cord 20.

Figure 7:
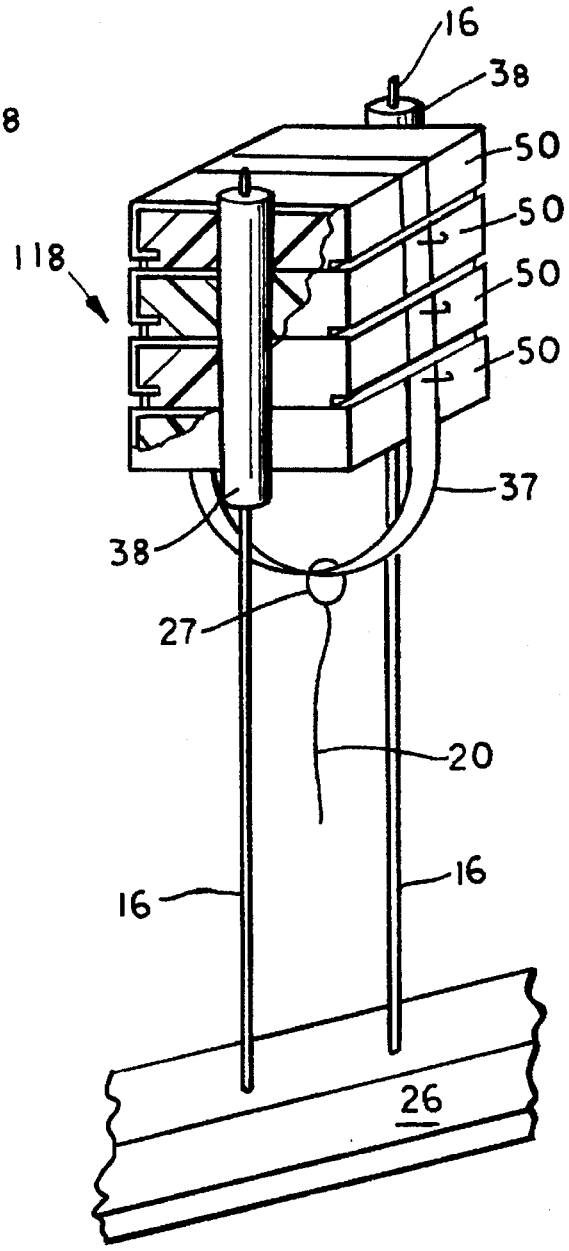
FIG. 7 is a view of another embodiment showing the float filled with a suitable material lighter than water.

FIG. 7 shows multiple float sections 50 filled with a suitable lighter than water material, such as a closed cell polyethylene foam.

Figure 8:
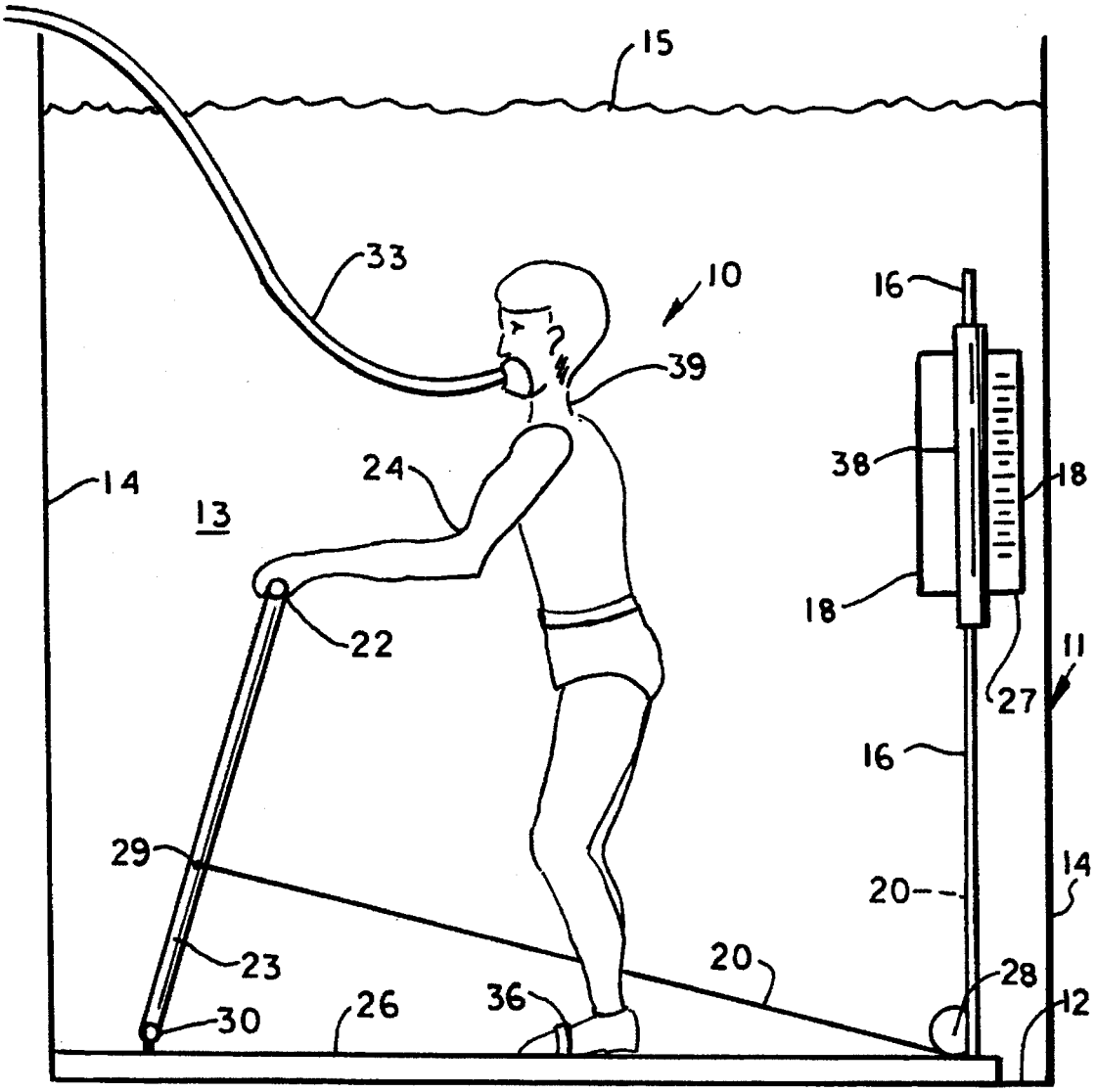
FIG. 8 shows the float completely underwater.

FIG. 8 shows float 18 and exercise device 10 used entirely underwater by a standing exercising person. Breathing equipment 33 enables the entire exercise to run underwater.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A resistance member for an aquatic exercise device comprising a float;

a first guide member fixed to said float;

a first post fixed in a generally upright position and slidably engaging said first guide member;

a flexible cord attached to said float at a first end whereby when a second end of said cord is attached to said exercise device said float will be directed by said first guide member along said post and a resistance force from said float will be applied to said exercise device through said cord.

2. The resistance member recited in claim 1 further comprising a second guide member and a second post;

said first and said second guide members being fixed to opposite sides of said float;

said second post being fixed in a generally upright position and slidably engaging said second guide member.

3. The resistance member recited in claim 1 further comprising more than one float attached together to provide said resistance force.

4. The resistance member recited in claim 1 wherein said float is air filled.

5. The resistance member recited in claim 1 wherein said float is filled with a lighter than water material.

6. The aquatic exercise device recited in claim 1 wherein multiple floats are attached together to provide a desired amount of resistance force.

7. The aquatic exercise device recited in claim 1 wherein said float is air filled.

8. The aquatic exercise device recited in claim 7 wherein said float has side walls made of transparent material;

indicia are provided on said side walls whereby the floatation force of said float is indicated in 1–400 pounds.

9. The aquatic exercise device recited in claim 1 wherein said float is filled with a lighter than water material.

10. The aquatic exercise device recited in claim 1 wherein said float is made of transparent material.

11. An aquatic exercising device comprising an enclosure having a bottom and water in said enclosure;

a float supported on said water;

a handle connected to said float;

connecting means whereby said handle is connected to said float;

said handle being adapted to be grasp by a person moving said float thereby exerting a force on said float;

said float has side walls made of transparent material;

indicia are provided on said side walls whereby the floatation force of said float is indicated;

said connecting means comprises a cord attached to said float and said handle being attached to said cord;

a post supported on said bottom;

spaced tubular members are attached to said float and slidably received on said post whereby said float is guided up and down when a person moves said handle.

12. The aquatic exercise device recited in claim 11 wherein said post is supported on said bottom;

spaced tubular members are attached to said float and slidably received on said post whereby said float is guided up and down when said person moves said handle.

13. An aquatic exercise device comprising an enclosure;

water in said enclosure;

said water having a top surface;

said enclosure having a bottom;

a float supported on said top surface of said water;

a handle attached to said float;

said float having indicia thereon whereby the depth of said float in said water can be observed;

said handle being adapted to be engaged by a person exerting a force on said handle to submerge said float in said water;

said float is made of transparent material;

said bottom has a first opening for admitting air into said float;

said top surface has a valve for releasing air from said float;

a lever is swingably attached to a base and extends upwardly therefrom to said handle;

said handle is attached to said lever;

a first pulley is attached to said bottom below said float;

a second pulley is attached to said enclosure;

said lever is disposed between said first pulley and said second pulley whereby a person can grasp said handle and pull said handle toward himself pulling a cord toward himself and thereby moving said float downward.

14. The aquatic exercise device recited in claim 13 wherein said bottom has a first opening for admitting air into said float; and, said top surface has a valve for releasing air from said float.

15. The aquatic exercise device recited in claim 13 wherein said top surface of said water is substantially at the shoulders of said person.

16. The aquatic exercise device recited in claim 13 wherein a lever is swingably attached to a bottom and extends upwardly therefrom to said handle;

said handle is attached to said lever.

17. The aquatic exercise device recited in claim 13 wherein multiple floats are attached together to provide a desired amount of flotation force.

18. The aquatic exercise device recited in claim 13 wherein said float is air filled.

19. The aquatic exercise device recited in claim 13 wherein said float is filled with a lighter than water material.

20. A method of aquatic exercise comprising providing an enclosure having a bottom containing water having a top surface and adapted to have a person in said water and a post supported on said bottom and;

a float on said top surface slidably supported on said post;

and hand engaging means attached to said float;

having said person engage said hand engaging means and exert a force on said hand engaging means whereby said float is at least partially submerged in said water;

having said person repeatedly exert said force on said hand engaging means and release said force whereby said float slides on said post and is submerged and returned to said surface of said water.

21. The method of claim 20 further providing making said float of transparent material and having indicia means thereon indicating the amount said float is submerged in said water when exerting said force on said float.

* * * * *